US005412821A

United States Patent [19]

Wilkinson

[11] Patent Number: 5,412,821

[45] Date of Patent: May 9, 1995

[54] PRESSURE RELIEF SUPPORT SYSTEM FOR A MATTRESS

[75] Inventor: John W. Wilkinson, Bennington, Vt.

[73] Assignee: Span-America Medical Systems, Inc., Greenville, S.C.

[21] Appl. No.: 793,576

[22] Filed: Nov. 18, 1991

Related U.S. Application Data

[62] Division of Ser. No. 601,314, Oct. 22, 1990, Pat. No. 5,070,560.

[51] Int. Cl.[6] ..... A47C 29/00

[52] U.S. Cl. ..... 5/455; 5/462; 5/236.1; 5/474

[58] Field of Search ..... 5/455, 457, 462, 480, 5/236.1, 237, 238, 241, 448, 449, 474, 464, 465, 481

[56] References Cited

U.S. PATENT DOCUMENTS

| | | | |
|---|---|---|---|
| 646,542 | 4/1900 | Lively . | |
| 779,576 | 1/1905 | Berryman | 5/455 |
| 1,307,825 | 6/1919 | Marshall | 5/455 |
| 1,332,673 | 3/1920 | Marshall | 5/455 |
| 1,347,666 | 7/1920 | Amey . | |
| 1,746,709 | 2/1930 | Marshall | 5/455 |
| 2,039,289 | 5/1936 | Bergeron | 5/455 |
| 2,225,858 | 12/1940 | Church | 5/239 |
| 2,543,218 | 2/1951 | Young et al. . | |
| 2,576,455 | 11/1951 | Gratt . | |
| 2,638,606 | 5/1953 | Austin | 5/239 |
| 3,027,967 | 3/1962 | Silver . | |
| 3,110,042 | 11/1963 | Slemmons . | |
| 3,146,469 | 9/1964 | Slade . | |
| 3,293,671 | 12/1966 | Griffin . | |
| 3,319,274 | 5/1967 | Upton . | |
| 3,534,416 | 10/1970 | Ackerman . | |
| 3,534,417 | 10/1970 | Boyles . | |
| 3,538,521 | 11/1970 | Basner . | |
| 3,742,528 | 7/1973 | Munch . | |
| 3,828,378 | 8/1974 | Flam | 5/345 R |
| 3,967,331 | 7/1976 | Glassman . | |
| 4,080,675 | 3/1978 | Kanowsky et al. . | |
| 4,150,447 | 4/1979 | Miller | 5/455 |
| 4,181,991 | 1/1980 | Morgan et al. . | |
| 4,346,489 | 8/1982 | McMullan | 5/455 |
| 4,365,371 | 12/1982 | Boussaroque . | |
| 4,477,935 | 10/1984 | Griffin | 5/241 |
| 4,525,886 | 7/1985 | Savenije | 5/464 |
| 4,628,557 | 12/1986 | Murphy | 5/446 |
| 4,682,378 | 7/1987 | Savenije | 5/455 |
| 4,706,313 | 11/1987 | Murphy | 5/464 |
| 4,803,744 | 2/1989 | Peck et al. . | |
| 4,827,544 | 5/1989 | Husler | 5/236 |
| 5,065,485 | 11/1991 | Zocco | 5/470 |

FOREIGN PATENT DOCUMENTS

| | | | |
|---|---|---|---|
| 0038155 | 6/1981 | European Pat. Off. . | |
| 136261 | 4/1985 | European Pat. Off. | 5/455 |
| 1038851 | 6/1951 | France | 5/455 |
| 2407692 | 11/1977 | France . | |
| 2446092 | 1/1979 | France . | |
| 1940763 | 1/1971 | Germany . | |
| 2254986 | 11/1972 | Germany . | |
| 3505644 | 8/1986 | Germany . | |
| 336864 | 4/1965 | Switzerland . | |
| 439627 | 12/1967 | Switzerland . | |
| 1304373 | 1/1973 | United Kingdom . | |
| 8102384 | 9/1981 | WIPO . | |

*Primary Examiner*—Flemming Saether
*Attorney, Agent, or Firm*—Dority & Manning

[57] ABSTRACT

The pressure relief support system contains longitudinal air cylinders having wood slats extending across the air cylinders along the length of the air cylinders forming the shape of a mattress. Foam strips may be included on each of these slats to provide an improved pressure relief mattress system for optimal patient comfort.

20 Claims, 3 Drawing Sheets

PRESSURE RELIEF SUPPORT SYSTEM FOR A MATTRESS

This application is a division of application Ser. No. 07/601,314, filed Oct. 22, 1990, now U.S. Pat. No. 5,070,560.

BACKGROUND OF THE INVENTION

This invention relates to the field of mattresses and more particularly, to a containment system for a mattress.

Particularly in hospitals which care to persons indefinitely confined to a bed, patients often suffer from the effects of excess pressure transmitted to their bodies. The excess pressure often results in painful bedsores and is a direct result of the mattress, the patients position therein and the length of time the patient remains in a particular position.

Hospitals rate pressure relief support systems as treatment products if they sufficiently reduce the pressure upon the patient's body, reduce tissue trauma, and facilitate the healing of skin ailments, such as burns, etc. Typical pressure relief support systems which qualify as treatment products are embodied in beds which contain motors and pumps to vary the shape and pressure within the mattress. Such beds are very expensive and require the operator to undergo extensive training to learn how to use and operate the system. Moreover, such treatment products often require extensive maintenance due to the failure of the numerous moving mechanical parts. These beds have a tendency, due to their complicated construction and design, to be extremely hot thereby transferring heat to the patient's body creating a most uncomfortable condition. Also, since these complicated pressure relief support systems require specialized bed frames they cannot be used on typical box spring mattress supports. The complicated design of these beds makes their repair very difficult often requiring complete substitution of the entire system for proper servicing.

It is therefore an object of the present invention to provide a pressure relief support system which is extremely comfortable, relatively inexpensive and utilizes a simple design so that there is no need for motors, specialized bed frames and extensive training for its use and maintenance.

It is also an object of the present invention to provide a pressure relief support system mattress which qualifies as a treatment product for use in hospitals.

It is also an object of the present invention to provide a pressure relief support system which allows for a more even body weight distribution thereby reducing pressure on the tissue and skin of the patient.

It is also an object of the invention to provide a pressure relief support system which can be customized to a particular patient's physical characteristics such as weight, contour, and body proportion.

Another object of the invention is to create a pressure relief support system which facilitates a cool, body moisture permeable bed surface for maximum patient comfort.

It is also an object of the present invention to provide a containment system for a pressure relief support system for a mattress which allows easy access and replacement of components of the mattress.

SUMMARY OF THE INVENTION

The foregoing problems of the prior art may be avoided by incorporating a containment system within a pressure relief support system in accordance with the principles of the present invention.

The containment system may comprise a casing, for surrounding air cylinders the casing having a plurality of sleeves thereon for receiving slats therein. The containment system allows air cylinders and slats to be easily removed without disturbing the other slats and air cylinders. The containment system provides a firm yet comfortable mattress when the patient lies on the surface of the mattress nearest to the slats. Furthermore, the mattress can be turned upside down wherein the slats are on the underside to provide a softer surface which a particular patient may desire.

DETAILED DESCRIPTION

Figure 1:
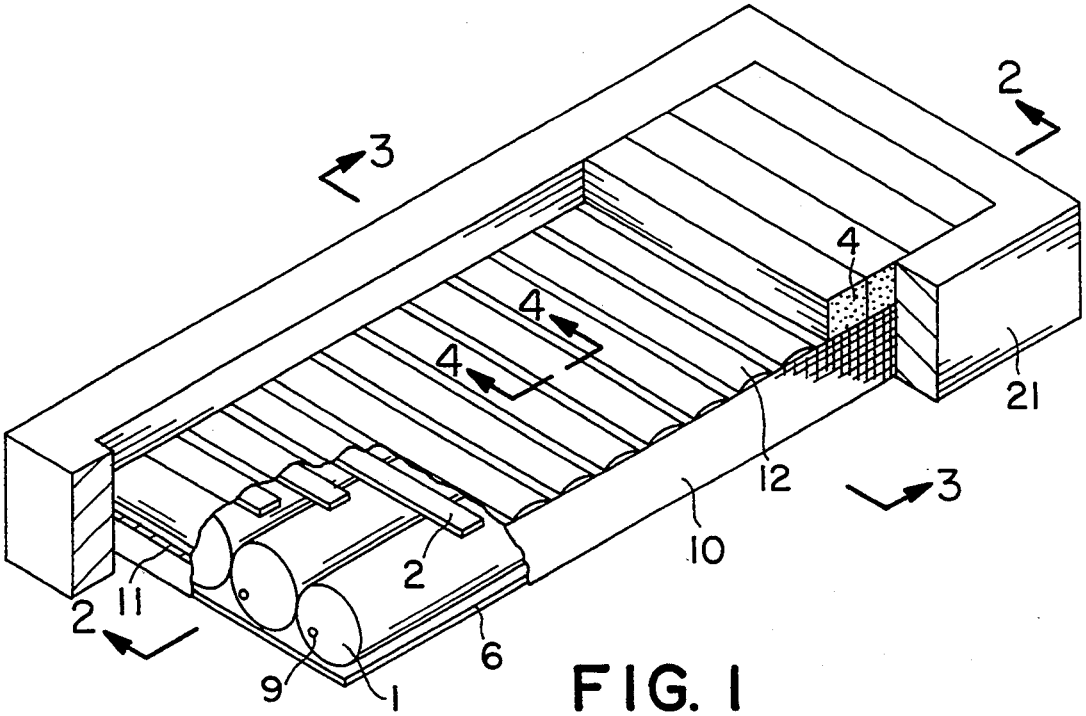
FIG. 1 is an isometric drawing of the first embodiment of a pressure relief support system for a mattress incorporating the containment system according to present invention without the outer cover and with several foam strips removed for clarity.

Referring to FIGS. 1 an embodiments of a pressure relief support system utilizing the containment system in accordance with the present invention is shown.

The pressure relief support system preferably contains four cylindrically shaped air cylinders 1 extending longitudinally throughout the length of the entire mattress, slats 2, foam strips 4, a liner 6, an outer cover 5 and a containment system 10.

Figure 4:
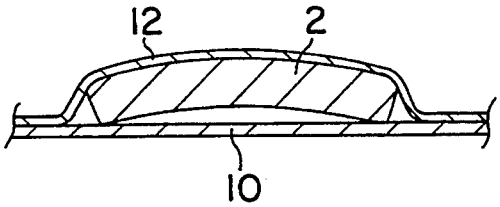
FIG. 4 is a cross sectional view of a slat within a sleeve of the containment system useable in the system depicted in FIG. 1.

The positions of the air cylinders generally define the shape and size of the mattress. Each air cylinder has a valve 9 therein for allowing air to pass therethrough thereby adjusting the pressure within the cylinder. The containment system may include a casing 10, having sleeves 12 therein, which covers the air cylinders, as shown in FIG. 1. The slats 2 are mounted across the air cylinders in a lateral direction substantially perpendicular to the length of the air cylinders 1 such that each slat extends continuously between each side of the mattress. The slats 2 preferably have an arcuately shaped cross section, as shown in FIG. 4, and are made of polystyrene or rigid PVC to provide a surface which is flexible yet capable of supporting heavy weight. The slats may be oriented such that the convex side of the slat is opposite the air cylinders. Since the patient will lie on the convex side of the slats, less pressure will be exerted on the patient's body from the edges of the slats. Also, each slat 2 may be spaced at an equal distance from the neighboring slat 2 throughout the entire length of the air cylinders 1 thereby forming a uniform row of slats 2.

Figure 5:
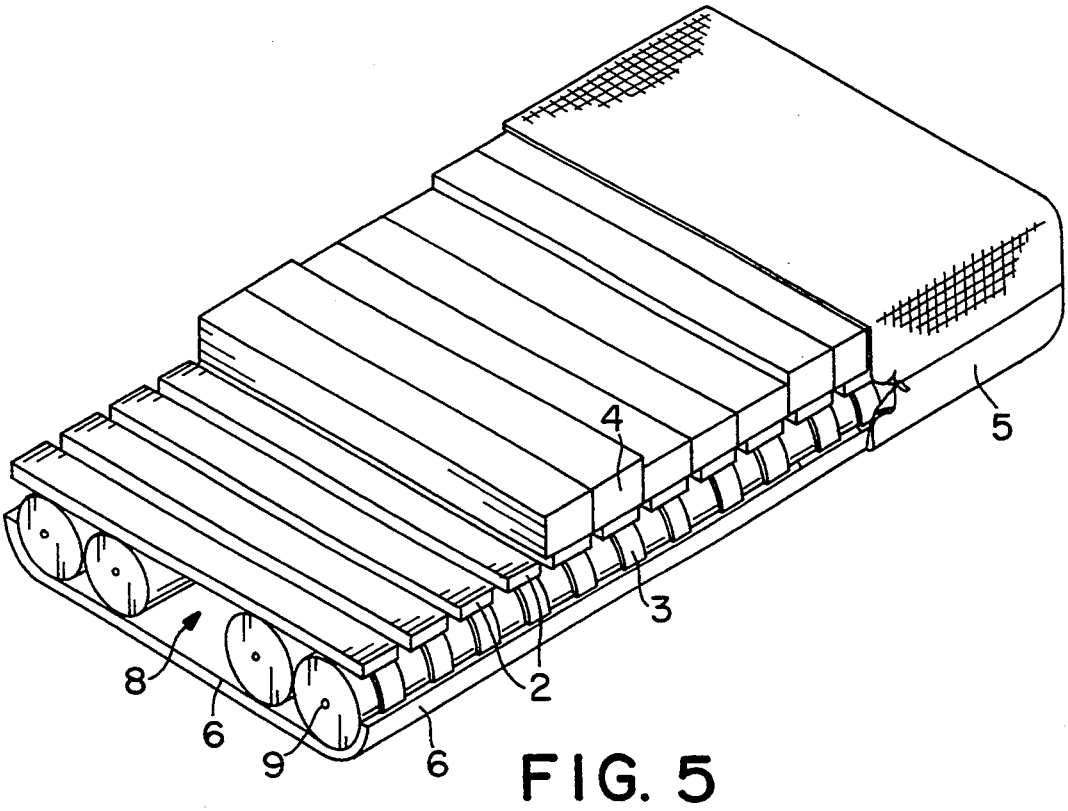
FIG. 5 is an isometric view of a second embodiment of the pressure relief support system according to the present invention with a portion of the foam strips and cover removed.
Figure 6:
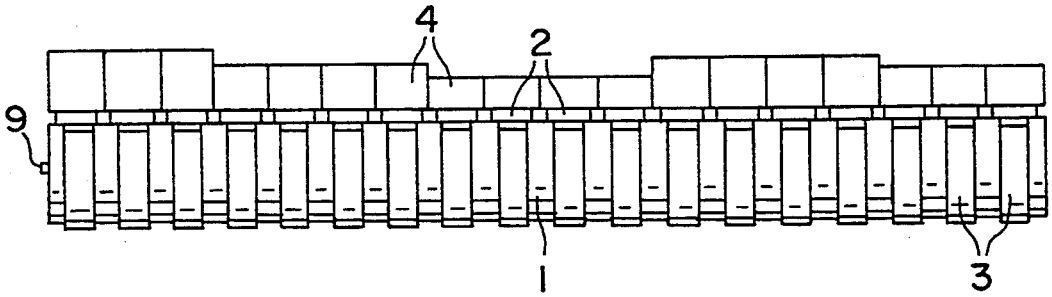
FIG. 6 is a side view of the embodiment depicted in FIG. 5 without the outer cover and liner.
Figure 7:
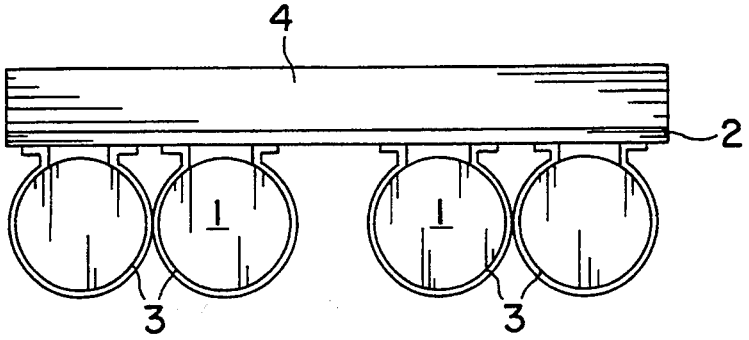
FIG. 7 is a front view of the embodiment depicted in FIG. 5.
Figure 8:
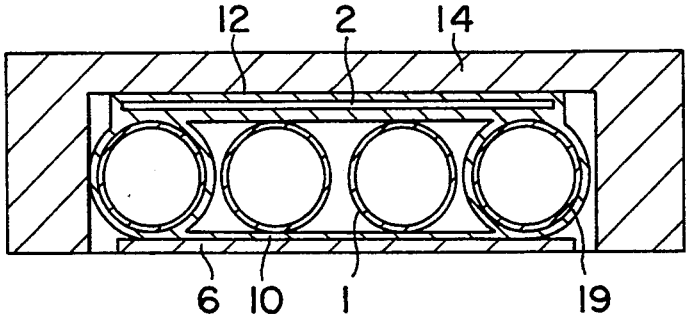
FIG. 8 is a sectional view of the embodiment of FIG. 1 of the present invention including a single foam piece covering the slats in lieu of the individual foam strips.

As shown in FIGS. 1 and 5, foam strips 4 are mounted on the topside of the slats 2 such that each individual slat contains a single foam strip 4 on the top thereof. The foam strips 4 may be attached directly to the slats 2 as shown in FIG. 4, or in the embodiment of FIG. 1 directly to sleeves 12 of the casing 10, by velcro or some other suitable means. Each foam strip 4 may be of a different height. All of the foam strips may be arranged in such a manner that the overall pattern of the mattress surface may accommodate the particular contour of a patient's body. Moreover, since the foam strips 4 are removable, the strips can be rearranged to form a different contour suitable for yet a different patient.

The densities of each foam strip 4 may differ enabling the cushioning effect and pressure on each section of the patient's body to vary depending upon which particular density foam is used. Different density foam strips may be placed at different locations along the length of the mattress to accommodate a particular patient's needs. For example, at the portion of the mattress which supports the head, a softer density foam strip 4 may be used as compared to the portion of the mattress which supports the small of the back. By using various density foam strips 4, the pressure exerted on a patient's body may be varied at different locations to provide optimum comfort to the patient. By utilizing both different height and different density combinations of foam strips each individual pressure relief support system can be customized to suit a particular person's contour, and comfort needs.

The individual slats 2, and foam strips 4 thereon are capable of each holding and supporting different weights and pressures. Each slat 2 and foam strip acts as an individual support thereby reducing the shear force transmitted along the length of the pressure relief support system. This shear force is present in conventional mattresses and is transmitted directly to the patient's body. However, since the individual slats 2 and foam strips 4 do not transmit a shear force to the neighboring slat and foam strip, improved comfort is attained. Moreover, each foam strip 4 can be individually wrapped to further reduce the shear force transmitted between each individual strip. Individual wrapping of the foam strip decreases the friction between neighboring foam strips allowing each strip to more freely expand or contract relative to the adjacent foam strip. This particular feature helps to further reduce the shear force transmitted by the foam strips.

The removable outside cover 5 may be a breathable, stretchable, body moisture permeable fabric such as Gor-tex which is pleated to help reduce shear. The outside cover 5 may be capable of transmitting air from the inner portion and air space 8 shown in FIG. 5, to the patient's body. Therefore, a cool mattress surface may be created which generally is more comfortable to the patient. Moreover, the system is less propensive to heat buildup thereby further protecting the patient from dehydration. Since the outside cover 5 may be stretchable, it helps to reduce shear and pressure on the patient's body to provide for a very comfortable surface. Preferably, the removable cover 5 is also made of a material similar to Gor-tex which is body moisture permeable thereby allowing moisture from the body to pass through the removable outer cover while allowing air to flow through the cover to the patient's body. The outside cover encases the foam strips and wood slats and is shaped similar to a conventional fitted sheet for a mattress.

Figure 2:
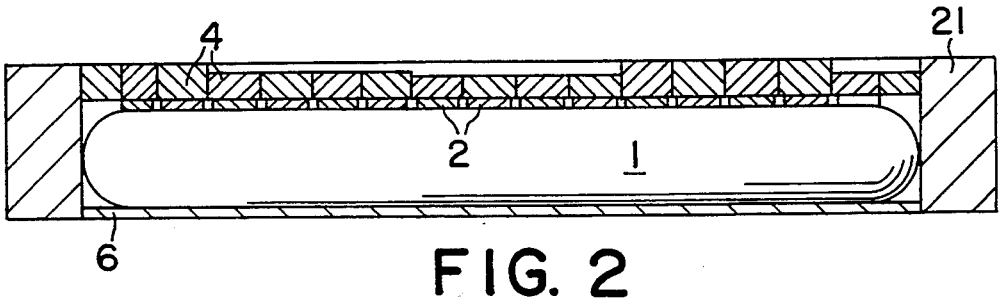
FIG. 2 is a sectional view of the embodiment depicted in FIG. 1 along line 2—2.

As shown in FIG. 1, the slats 2 are secured by a casing 10. The casing 10 is shaped so as to allow for the air cylinders 1 to be inserted therein and form the configuration of a mattress. The casing contains a zipper 11 which allows for the air cylinders 1 to be easily accessed for insertion, removal, inflation, or deflation. The casing contains a plurality of sleeves 12 which receive the slats 2 therein. When the slats 2 are inserted into the casing sleeves 12, a row of slats extends substantially parallel across the top of the air cylinders. Also, as shown in FIG. 2, a foam border 21 may surround the perimeter of the casing 10. Although the outer cover 5 is not shown in FIG. 1, the outer cover should be used thereon.

Figure 3:
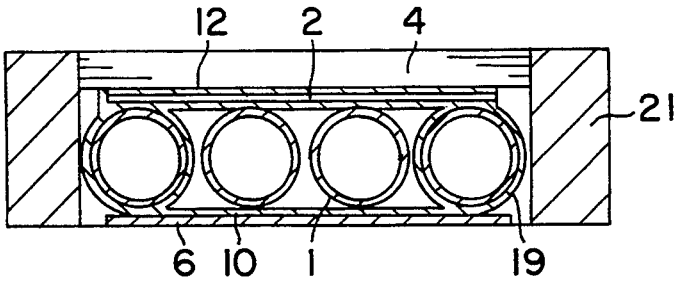
FIG. 3 is a sectional view of the embodiment depicted in FIG. along line 3—3.

The area of the casing 10 between sleeves 12 may be perforated or air permeable to allow for air to flow through the casing to keep the mattress surface cool and comfortable. Also, as shown in FIG. 3, the casing 10 may have supports 19 which form compartments therein where the air cylinders 10 are inserted. The compartments may be configured to prevent the air cylinders 1 from shifting out of place and/or to form air gaps between two or more cylinders 1 further helping to cool the mattress surface.

Between the outer cover 5 and the bottom of the air cylinders 1 is a felt liner 6 which helps prevent friction between the cylinders 1 and the outer cover 5. The outer cover 5 may completely surround the casing and contain a zipper located on the side and ends to allow access to the casing 10, slats 2, and cylinders 1.

The foam strips may be eliminated from the system such that the outer cover 5 surrounds the air cylinders 1 and slats 2 without foam strips. The patient may lie on the surface of the system directly on top of the slats 2. Alternatively, a solid piece of foam 14 may be placed on top of the slats in lieu of the individual foam strips as shown in FIG. 5. The foam 14 covers the sides and the top of the casing 10. Despite the absence of the foam strips, the pressure on the patient's body is substantially reduced over conventional mattresses. The individual slats 2 provide a substantially shear free surface upon the body to create a firm, comfortable surface. The pressure relief support system may also be used in a inverted or upside down position so that the patient lies upon the air cylinder 10 side of the mattress and the slats 2 are located below the air cylinders 1. In this manner, the slats 2 are not in contact with the patient's body. When the pressure relief support system is used in this way, a hammocking effect is created on the-patient's body and the patient feels a much softer surface. This may be appropriate when, for instance, the patient suffers severe burns along the back of his body.

While the invention has been described and illustrated in the embodiments depicted herein, it is not intended to be limited to the details shown, since various modifications and structural changes may be made without departing, in any way, from the spirit of the invention. Any such modifications are intended to be within the scope of the invention as defined by the claims.

I claim:

1. A pressure relief support system for a mattress, comprising:

a substantially rectangular casing, said casing including an inner area removably supporting a plurality of respective sealable fluid filled elongate cylinders therein in a predetermined substantially parallel arrangement along the length of a longitudinal first direction of said casing so as to substantially define the shape and size of said mattress;

a plurality of substantially mutually parallel sleeves formed on a selected first side of said casing, said sleeves being situated over the length of said elongate cylinders and extending in a lateral direction substantially perpendicular to said first direction of said casing, and said sleeves being formed for removably receiving respective independent slats therein for providing independent lateral slat user support for reducing longitudinal shear forces on such user;

a plurality of individual relatively firm slats respectively and removably received in said plurality of sleeves such that selected of said slats may be easily alternately inserted into and removed from respective of said sleeves without disturbing the remainder of said slats and without disturbing said predetermined arrangement of said cylinders;

selective closure means for selectively exposing said casing inner area such that selected of said elongated cylinders with selected amounts of fluid therein may be easily alternately inserted into and removed from said casing inner area without disturbing said arrangement of the remainder of said cylinders in relation to said casing and without disturbing said slats received in their respective sleeves; and support means within said casing inner area for forming predetermined compartments for the insertion of at least selected of said elongate cylinders therein so as to form said predetermined arrangement thereof.

2. The system of claim 1, wherein said support means compartments are integrally formed with said casing.

3. The system of claim 1, wherein said support means comprise at least a pair of said compartments located within said casing inner area and fixed in respective predetermined locations so as to correspondingly fix their respectively received elongate cylinders with a predetermined air space therebetween.

4. The system of claim 1, further comprising foam located atop said sleeves, with an upper side of said foam providing a user support surface.

5. The system of claim 4, wherein said foam includes a single foam piece covering said plurality of sleeves.

6. The system of claim 4, wherein said foam includes a plurality of respective foam strips associated with corresponding respective individual slats and supported thereabove such that respective slat and foam strip pairs collectively form respective individual user supports for reducing longitudinal shear forces on a user received on said user support surface.

7. The system of claim 6, wherein said foam strips are removably secured and have preselected support characteristics so as to be arranged in selected positions for selected support of a user thereon.

8. The system of claim 7, wherein said preselected support characteristics include a selected thickness and density for each foam strip so as to select the stiffness and contour of the user support surface formed therewith.

9. The system of claim 5, wherein said single foam piece further comprises a foam border received around the perimeter of said casing.

10. The system of claim 4, further comprising:

a foam border received around the perimeter of said casing; and a removable outer cover received around said casing, said sleeves, said foam atop said sleeves, and said foam border around said casing.

11. The system of claim 10, further including a protective liner situated inside said outer cover and beneath said cylinders.

12. The system of claim 10, wherein said removable outer cover comprises air and moisture permeable material.

13. The system of claim 1, wherein said fluid contained in said cylinders is a gaseous fluid.

14. The system of claim 1, wherein:

said plurality of cylinders comprise at least four respective air cylinders removably received in said casing inner area; and said support means are formed in said casing inner area for securing at least a pair of said air cylinders in predetermined locations therein such that predetermined air spaces are formed between such air cylinders.

15. The system of claim 14, wherein:

said air cylinders are respectively sealed with valves for adjustment of the amount of air therein; and said support means include at least a pair of sleeves on respective lateral sides of said casing inner area for receiving respective air cylinders therein.

16. The system of claim 1, wherein said plurality of slats are respectively arcuately shaped in cross section, and situated so that convex sides thereof face opposite said cylinders.

17. An improved patient support system with laterally self-equalizing static air pressure relief, said system comprising:

a selectively closable inner casing comprised of air permeable material and forming a generally rectangular inner chamber;

at least four generally cylindrical respectively inflatable air bladders removably received in parallel inside said inner casing inner chamber, said bladders having respective valves for selected respective inflation thereof;

compartment means integrally formed in predetermined locations within said inner casing for positioning of said air bladders in a longitudinal direction relative to said inner casing and with a predetermined air spacing among said bladders, said compartment means and said inner casing collectively permitting individual bladders to be removed, adjusted, and reinserted relative to said inner casing inner chamber without disturbing other of said bladders therein;

a plurality of sleeves integrally formed on an upper side of said inner casing, and in spaced, mutually parallel relationship along the full longitudinal direction of said inner casing and perpendicular to such longitudinal direction;

a plurality of slats corresponding with said sleeves and respectively removably received therein, said slats independently providing longitudinal shear force relief to a patient using said system while also providing lateral transmission of patient pressure forces across the longitudinally positioned air bladders therebeneath, so that such forces are laterally self-equalized, said slats also being selectively and respectively removable and insertable relative to said sleeves without disturbing other of said slats;

a border of resilient foam material formed around the perimeter of said inner casing and extending thereabove;

a main body of foam having a first surface received on top of said sleeves, said main body of foam being situated within said border and having an upper patient support surface opposite said first surface thereof; and a selectively closable outer casing received about all other elements of said system, and comprised of air and moisture permeable material for coolness and comfort of a patient using said system.

18. An improved patient support system as in claim 17, further including:

a protective liner received within said outer casing and beneath said air bladders; and wherein said main body of foam comprises resilient foam material integrally associated with said border.

19. An improved patient support system as in claim 17, further including:

a protective liner received within said outer casing and beneath said air bladders; and wherein said main body of foam comprises a plurality of individual foam strips respectively removably supported above each respective slat and extending substantially along the length of such slat, so that respective foam strip and slat pairs operate collectively though independently from other foam strip and slat pairs for providing individual patient supports which reduce longitudinal shear forces on a patient using said system, said foam strips each having selected support characteristics so that preselected patient support can be established for each given patient using said system by selective positioning of said individual foam strips.

20. An improved patient support system as in claim 17, wherein said compartment means comprise a pair of generally circular sleeve arrangements at respective lateral locations within said inner casing inner chamber, such that a corresponding two of said air bladders are respectively received by said sleeve arrangements while the remaining two air bladders are received therebetween.

* * * * *